US010029302B2

(12) United States Patent
Breneman et al.

(10) Patent No.: US 10,029,302 B2
(45) **Date of Patent: *Jul. 24, 2018**

(54) DUAL INVESTMENT SHELLED SOLID MOLD CASTING OF RETICULATED METAL FOAMS

(71) Applicant: United Technologies Corporation, Farmington, CT (US)

(72) Inventors: Ryan C. Breneman, West Hartford, CT (US); Steven J. Bullied, Pomfret Center, CT (US); David R. Scott, Bristol, CT (US)

(73) Assignee: United Technologies Corporation, Farmington, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/682,982

(22) Filed: Aug. 22, 2017

(65) Prior Publication Data

US 2017/0348765 A1 Dec. 7, 2017

Related U.S. Application Data

(63) Continuation of application No. 14/960,744, filed on Dec. 7, 2015, now Pat. No. 9,737,930, which is a (Continued)

(51) Int. Cl.
*B22C 9/22* (2006.01)
*B22D 25/00* (2006.01)
(Continued)

(52) U.S. Cl.
CPC ..... *B22C 9/22* (2013.01); *B22C 1/00* (2013.01); *B22C 7/02* (2013.01); *B22C 7/023* (2013.01);
(Continued)

(58) Field of Classification Search
CPC ..... B22D 25/005; B22C 9/00; B22C 9/04; B22C 9/043; B22C 9/046
See application file for complete search history.

(56) References Cited

U.S. PATENT DOCUMENTS 3,362,463 A 1/1968 Manginelli
3,616,841 A 11/1971 Walz
(Continued)

FOREIGN PATENT DOCUMENTS

CN 103117258 A 5/2013
EP D158082 A2 10/1985
(Continued)

OTHER PUBLICATIONS

European Search Report dated Jun. 8, 2016 for European Patent Application No. 16152132.3.
(Continued)

*Primary Examiner* — Kevin P Kerns
*Assistant Examiner* — Steven S Ha
(74) *Attorney, Agent, or Firm* — Bachman & LaPointe, P.C.

(57) ABSTRACT

A method to manufacture reticulated metal foam via a dual investment, includes pre-investment of a precursor with a diluted pre-investment ceramic plaster then applying an outer mold to the encapsulated precursor as a shell-mold.

4 Claims, 6 Drawing Sheets

Related U.S. Application Data continuation-in-part of application No. 14/600,717, filed on Jan. 20, 2015, now Pat. No. 9,789,536, and a continuation-in-part of application No. 14/619,372, filed on Feb. 11, 2015, now Pat. No. 9,789,534.

(51) Int. Cl.

| | |
|---|---|
| ***B22C 7/02*** | (2006.01) |
| ***B22C 1/00*** | (2006.01) |
| ***B22C 9/04*** | (2006.01) |
| ***B22D 27/09*** | (2006.01) |
| ***B22D 29/00*** | (2006.01) |

(52) U.S. Cl.

CPC ..... *B22C 9/04* (2013.01); *B22C 9/043* (2013.01); *B22D 25/005* (2013.01); *B22D 27/09* (2013.01); *B22D 29/002* (2013.01); *B22D 29/006* (2013.01)

(56) References Cited

U.S. PATENT DOCUMENTS

| | | | | |
|---|---|---|---|---|
| 3,788,382 | A | 1/1974 | Daniel et al. | |
| 3,933,190 | A | 1/1976 | Fassler et al. | |
| 3,946,039 | A * | 3/1976 | Walz | B22F 3/1121 164/113 |
| 4,045,536 | A | 8/1977 | Wallace | |
| 4,235,277 | A | 11/1980 | Aizawa et al. | |
| 5,720,597 | A | 2/1998 | Wang et al. | |
| 6,187,411 | B1 | 2/2001 | Palmer | |
| 6,412,541 | B2 | 7/2002 | Roesler et al. | |
| 6,443,700 | B1 | 9/2002 | Grylls et al. | |
| 6,652,222 | B1 | 11/2003 | Wojtyczka et al. | |
| 6,711,902 | B2 | 3/2004 | Douglas | |
| 6,827,556 | B2 | 12/2004 | Simon | |
| 6,857,461 | B2 * | 2/2005 | Girlich | B22D 19/14 164/34 |
| 6,913,436 | B2 | 7/2005 | McMillan et al. | |
| 6,971,841 | B2 | 12/2005 | Care | |
| 7,045,237 | B2 | 5/2006 | Sridhar et al. | |
| 7,067,208 | B2 | 6/2006 | Gottmann et al. | |
| 7,092,484 | B1 | 8/2006 | Jensen | |
| 7,118,920 | B2 | 10/2006 | Brophy et al. | |
| 7,125,217 | B2 | 10/2006 | Care | |
| 7,135,248 | B2 | 11/2006 | Finn et al. | |
| 7,137,433 | B2 | 11/2006 | Dobesberger et al. | |
| 7,144,651 | B2 | 12/2006 | Finn et al. | |
| 7,175,387 | B2 | 2/2007 | Kreis et al. | |
| 7,255,956 | B2 | 8/2007 | Mcelroy et al. | |
| 7,448,849 | B1 | 11/2008 | Webster | |
| 7,513,734 | B2 | 4/2009 | McMillan | |
| 7,524,162 | B2 | 4/2009 | Reigl | |
| 7,588,421 | B2 | 9/2009 | Burdgick et al. | |
| 7,594,325 | B2 | 9/2009 | Read | |
| 7,604,199 | B2 | 10/2009 | McMillan et al. | |
| 7,604,781 | B2 | 10/2009 | Brophy et al. | |
| 7,753,654 | B2 | 7/2010 | Read et al. | |
| 7,762,308 | B2 | 7/2010 | Crawford et al. | |
| 7,766,603 | B2 | 8/2010 | Beckford et al. | |
| 7,766,625 | B2 | 8/2010 | Burdgick et al. | |
| 7,775,766 | B2 | 8/2010 | Meier et al. | |
| 7,905,016 | B2 | 3/2011 | James et al. | |
| 7,922,456 | B2 | 4/2011 | McMillan | |
| 7,942,639 | B2 | 5/2011 | Burdgick et al. | |
| 7,946,827 | B2 | 5/2011 | Beckford | |
| 7,950,147 | B2 | 5/2011 | Meier et al. | |
| 7,968,144 | B2 | 6/2011 | James et al. | |
| 8,047,001 | B2 | 11/2011 | Beeck et al. | |
| 8,052,378 | B2 | 11/2011 | Draper | |
| 8,092,148 | B2 | 1/2012 | Seitz et al. | |
| 8,231,328 | B2 | 7/2012 | Reed | |
| 8,246,291 | B2 | 8/2012 | Wolford | |
| 8,297,912 | B2 | 10/2012 | Reed | |
| 8,304,136 | B2 | 11/2012 | Lee et al. | |
| 8,313,288 | B2 | 11/2012 | Schlichting et al. | |
| 8,327,911 | B2 | 12/2012 | Kush et al. | |
| 8,333,552 | B2 | 12/2012 | Wood et al. | |
| 8,721,290 | B2 | 5/2014 | Darkins, Jr. et al. | |
| 8,763,360 | B2 | 7/2014 | Murdock | |
| 8,777,582 | B2 | 7/2014 | Darkins, Jr. et al. | |
| 8,777,583 | B2 | 7/2014 | Darkins, Jr. et al. | |
| 8,870,547 | B2 | 10/2014 | Grase et al. | |
| 9,731,342 | B2 | 8/2017 | Breneman et al. | |
| 9,789,534 | B2 | 10/2017 | Noraas et al. | |
| 9,789,536 | B2 | 10/2017 | Noraas et al. | |
| 2003/0215689 | A1 | 11/2003 | Keegan | |
| 2004/0167270 | A1 | 8/2004 | Chang et al. | |
| 2009/0160092 | A1 | 6/2009 | Jahnz | |
| 2012/0144958 | A1 | 6/2012 | Olson, III et al. | |
| 2017/0001238 | A1 | 1/2017 | Breneman et al. | |

FOREIGN PATENT DOCUMENTS

| | | | |
|---|---|---|---|
| EP | 1604756 | A2 | 12/2005 |
| GB | 2010711 | A | 7/1979 |
| KR | 20100084734 | A | 9/2001 |

OTHER PUBLICATIONS

European Search Report dated Jun. 8, 2016 for European Patent Application No. 16152118.2.

European Search Report dated Oct. 27, 2016 for European Patent Application No. 16178354.3.

European Search Report dated Jun. 1, 2017 for European Patent Application No. 16202718.9.

T S Piwonka et al., "A comparison of lost pattern casting processes", Materials and Design, London, GB, vol. 11, No. 6, Dec. 1, 1990, pp. 283-290, XP024152793, ISSN: 0261-3069, DOI: 10.1016/0261-3069 (90) 90010-H.

Alexander Martin Matz et al., "Mesostructural Design and Manufacturing of Open-Pore Metal Foams by Investment Casting", Advances in Materials Science and Engineering, vol. 45, No. 1, Jan. 1, 2014, pp. 279-279, XP055314136, ISSN: 1687-8434, DOI: 10.2320/matertrans.47.2195.

European Search Report dated Sep. 30, 2016 for European Patent Application No. 16177372.6.

U.S. Non-Final Office Action dated Oct. 4, 2017 for U.S. Appl. No. 15/677,673.

U.S. Non-Final Office Action dated Nov. 29, 2017 for U.S. Appl. No. 15/785,929.

* cited by examiner

DUAL INVESTMENT SHELLED SOLID MOLD CASTING OF RETICULATED METAL FOAMS

CROSS REFERENCE TO RELATED APPLICATIONS

This application is a Continuation of U.S. patent application Ser. No. 14/960,744, filed Dec. 7, 2015, which is a Continuation-in-Part and claims the benefit of patent application Ser. No. 14/600,717, filed Jan. 20, 2015 and patent application Ser. No. 14/619,372, filed Feb. 11, 2015.

BACKGROUND

The present disclosure relates to metal foams, more particularly, to methods to manufacture metal foams.

Reticulated metal foams are porous, low-density solid foams that include few, if any, intact bubbles or windows. Reticulated metal foams have a wide range of application and may be utilized in many aerospace applications.

Numerous existing manufacturing technologies for producing reticulated metal foams have been attempted. However, automated production of such reticulated structures may be rather difficult to implement as the ceramic investment often proves difficult to remove without damage to the resultant relatively delicate metallic foam structure. Further, the existing manufacturing technologies lack the capability to efficiently manufacturer relatively large sheets of metal foam as the weight of the ceramic investment is sufficient to crush and convolute the shape of the polyurethane foam precursors. This may result in castability complications, polymer burnout, and reduced dimensional tolerances.

Standard investment casting in a flask tends to insulate the cast metal evenly resulting in heat retention in the center of the mold. This may lead to porosity in the casting and much effort is expended in mold design to direct this internal hot zone to non-critical areas of the casting.

SUMMARY

A method to manufacture reticulated metal foam via a dual investment, according to one disclosed non-limiting embodiment of the present disclosure can include pre-investing a precursor with a diluted pre-investment ceramic plaster to encapsulate the precursor; and applying an outer mold to the encapsulated precursor as a shell-mold.

A further embodiment of the present disclosure may include, wherein the precursor is a reticulated foam.

A further embodiment of the present disclosure may include, wherein the precursor is a polyurethane foam.

A further embodiment of the present disclosure may include, wherein the precursor is completely encapsulated with the diluted pre-investment ceramic plaster.

A further embodiment of the present disclosure may include coating the precursor to increase ligament thickness.

A further embodiment of the present disclosure may include coating the precursor in a molten wax to increase ligament thickness to provide an about 90% air to 10% precursor ratio.

A further embodiment of the present disclosure may include coating the precursor in a molten wax to increase ligament thickness to provide an about 90% air to 10% precursor ratio.

A further embodiment of the present disclosure may include, wherein the diluted pre-investment ceramic plaster is about 55:100 water-to-powder ratio.

A further embodiment of the present disclosure may include applying the outer mold by applying alternating layers of slurry and stucco to form the shell-mold.

A method to manufacture reticulated metal foam via a dual investment, according to another disclosed non-limiting embodiment of the present disclosure can include coating a precursor in a molten wax to increase ligament thickness; pre-investing the waxed precursor with a diluted pre-investment ceramic plaster to encapsulate the precursor; and applying an outer mold to the encapsulated precursor as a shell-mold.

A further embodiment of the present disclosure may include, wherein the precursor is a reticulated foam.

A further embodiment of the present disclosure may include coating the precursor in the molten wax to increase ligament thickness to provide an about 90% air to 10% precursor ratio.

A further embodiment of the present disclosure may include, wherein the ceramic plaster is more rigid than the diluted pre-investment ceramic plaster.

A further embodiment of the present disclosure may include, wherein the diluted pre-investment ceramic plaster defines a predetermined a water-to-powder ratio.

A further embodiment of the present disclosure may include, wherein the diluted pre-investment ceramic plaster is about 55:100 water-to-powder ratio.

A dual investment according to another disclosed non-limiting embodiment of the present disclosure can include a precursor; a diluted pre-investment ceramic plaster over the precursor; and a shell mold over the diluted pre-investment ceramic plaster.

A further embodiment of the present disclosure may include, wherein the precursor is reticulated foam.

A further embodiment of the present disclosure may include, a molten wax over the precursor to increase ligament thickness to provide an about 90% air to 10% precursor ratio.

A further embodiment of the present disclosure may include, wherein the ceramic plaster is more rigid than the diluted pre-investment ceramic plaster.

A further embodiment of the present disclosure may include, wherein the diluted pre-investment ceramic plaster is about 55:100 water-to-powder ratio and the ceramic plaster is about 28:100 water-to-powder ratio.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

Various features will become apparent to those skilled in the art from the following detailed description of the disclosed non-limiting embodiments. The drawings that accompany the detailed description can be briefly described as follows.

DETAILED DESCRIPTION

Figure 1:
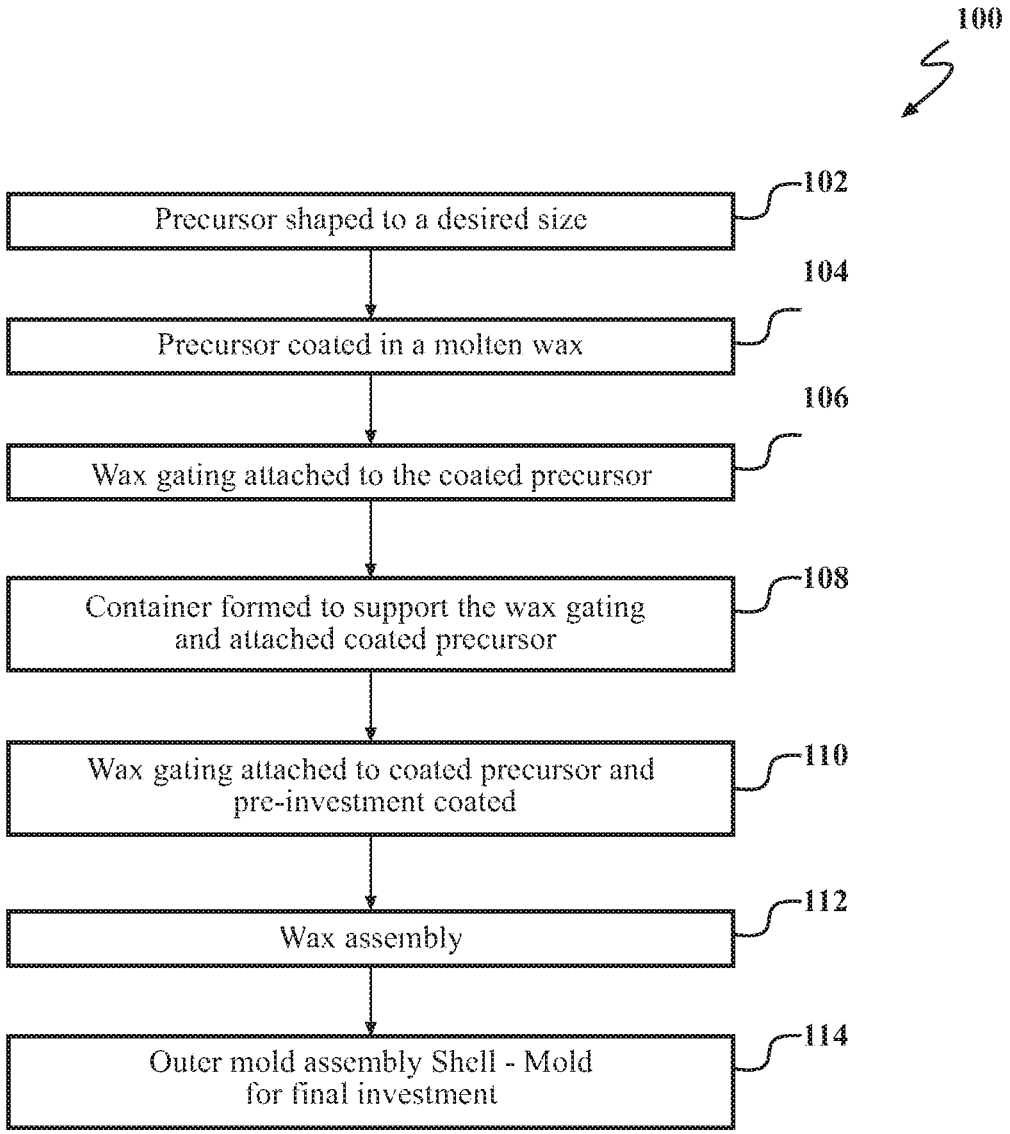
FIG. 1 is a schematic block diagram of a method to manufacture reticulated metal foam via a dual investment solid mold according to one disclosed non-limiting embodiment.

FIG. 1 schematically illustrates a method 100 to manufacture reticulated metal foam via a dual investment solid mold according to one disclosed non-limiting embodiment. The reticulated metal foam is typically manufactured of aluminum, however, other materials will also benefit herefrom.

Initially, a precursor 20 (FIG. 2) such as a polyurethane reticulated foam structure or other such reticulated material shaped to a desired size and configuration (step 102). In one example, the precursor 20 may be about 2' by 1' by 1.5". In some embodiments, the precursor 20 may be a commercially available 14 ppi polyurethane foam such as that manufactured by INOAC USA, INC of Moonachie, N.J. USA, although any material that provides desired pore configurations are usable herewith.

Figure 2:
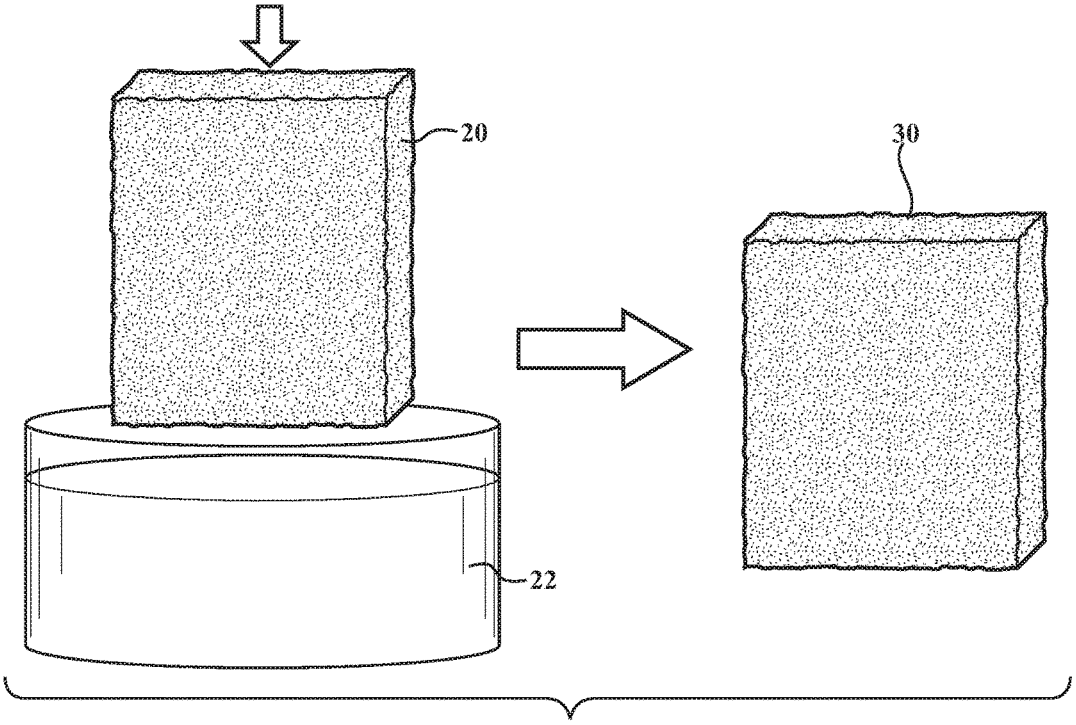
FIG. 2 is a schematic view of one step in the method to manufacture reticulated metal foam.

Next, the precursor 20 is heated, then dipped or otherwise coated in a molten wax 22 to increase ligament thickness (Step 104; FIG. 2). The wax may be melted in an electric oven at ~215° F. and the precursor 20 may be preheated simultaneously therein as well. In one example, the wax coating increased ligament/strut thickness to provide an about 90% air to 10% precursor ratio to facilitate castability with thicker struts and channels for metal, however, other densities will benefit herefrom as waxing the foam enables casting of the foam due to the passageways formed during de-wax and burnout. The wax coating also facilitates improved/accelerated burnout (passageways for gas).

It should be appreciated that various processes may be utilized to facilitate the wax coating such as location of the precursor 20 into the oven for a few minutes to re-melt the wax on the precursor 20; utilization of an air gun used to blow out and/or to even out the wax coating; and/or repeat the re-heat/air gun process as necessary to produce an even coating of wax. Alternatively, or in addition, the precursor 20 may be controlled by a CNC machine to assure that the wax coating is consistently and equivalently applied. The precursor 20 is then a coated precursor 30 that is then allowed to cool (FIG. 2).

Figure 3:
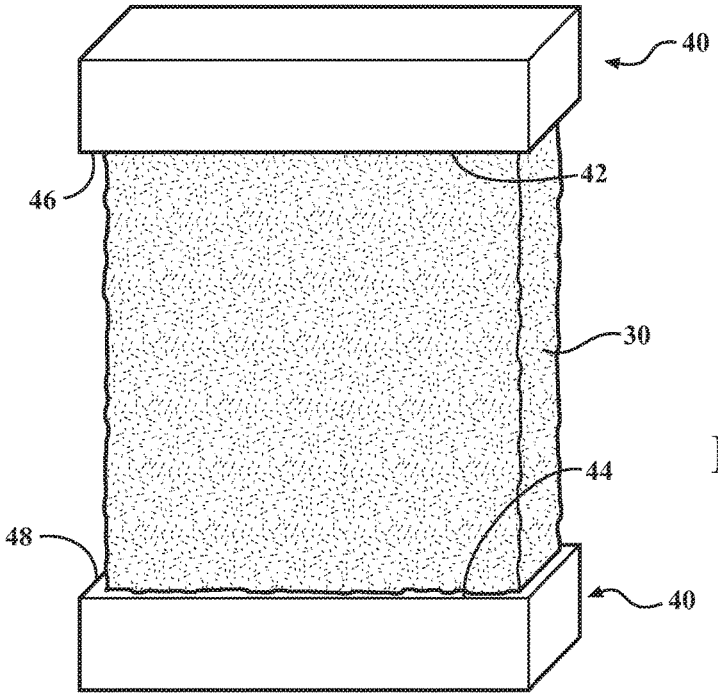
FIG. 3 is a schematic view of one step in the method to manufacture reticulated metal foam.

Next, a wax gating 40 is attached to each end 42, 44 of the coated precursor 30 (step 106; FIG. 3). An edge face 46, 48 of the respective wax gating 40 may be dipped into melted wax as a glue and attached to the coated precursor 30.

Figure 4:
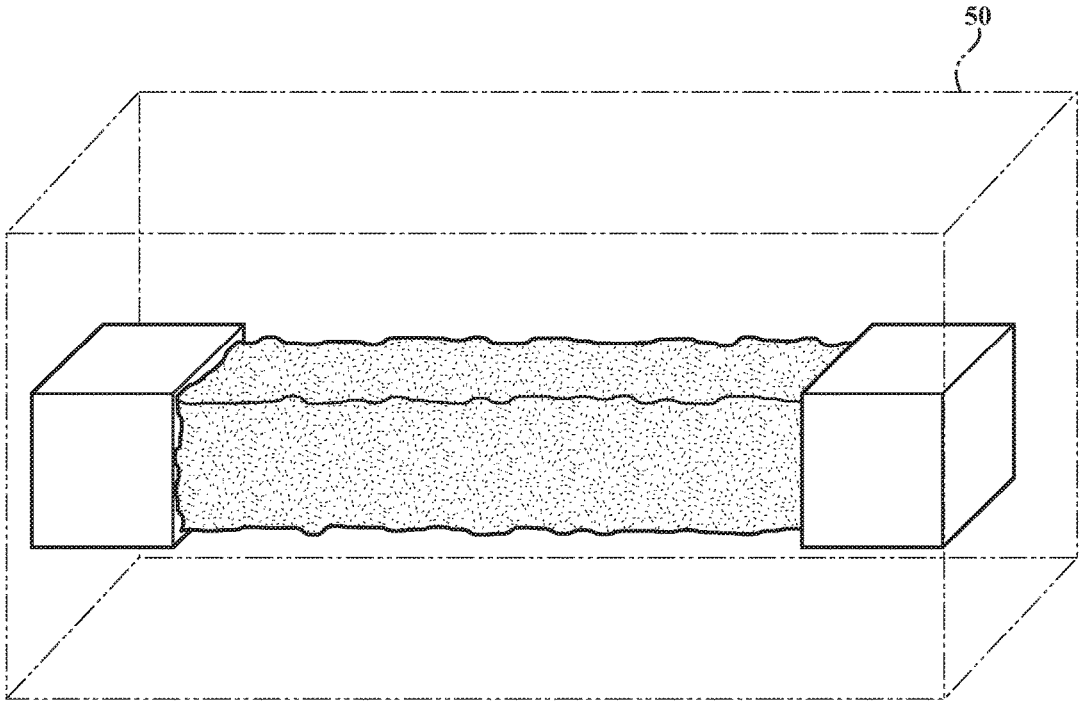
FIG. 4 is a schematic view of one step in the method to manufacture reticulated metal foam.
Figure 5:
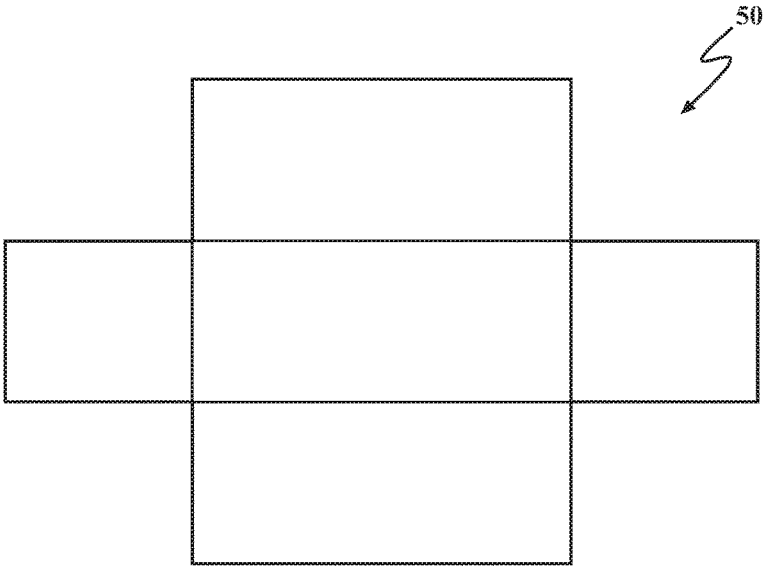
FIG. 5 is a schematic view of one step in the method to manufacture reticulated metal foam.

Next, a container 50 is formed to support the wax gating 40 and attached coated precursor 30 therein (step 108; FIG. 4). In some embodiments, the container 50 may be formed as an open-topped rectangular container manufactured from scored sheet wax of about 1/16" thick (FIG. 5). It should be appreciated that other materials such as plastic, cardboard, and others may be utilized to support the wax gating 40 and attached coated precursor 30 therein as well as contain a liquid such that the wax gating 40 can be completely submerged. In one example, the container 50 is about twice the depth of the wax gating 40 and provides spacing completely around the coated precursor 30.

Figure 6:
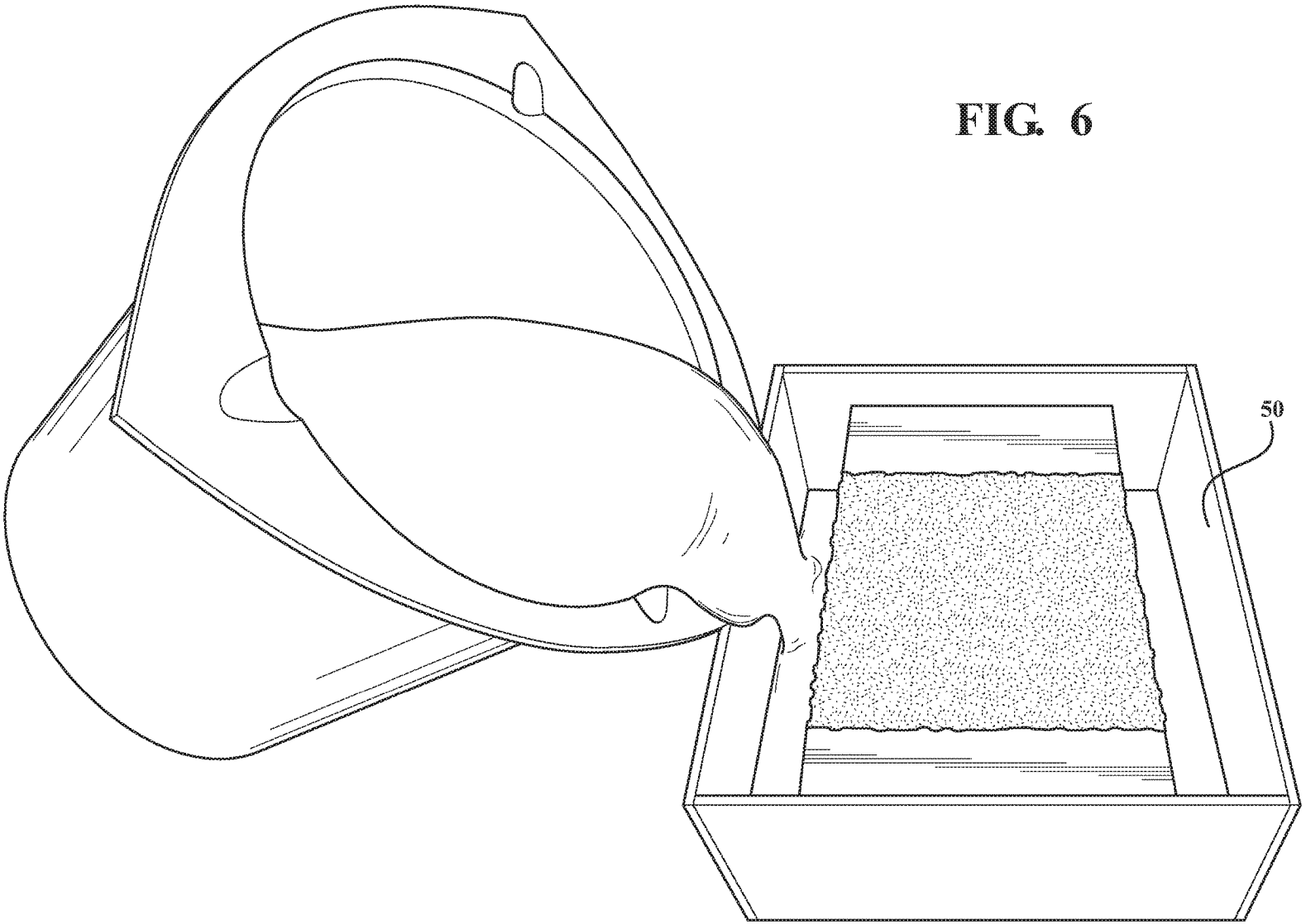
FIG. 6 is a schematic view of one step in the method to manufacture reticulated metal foam.
Figure 7:
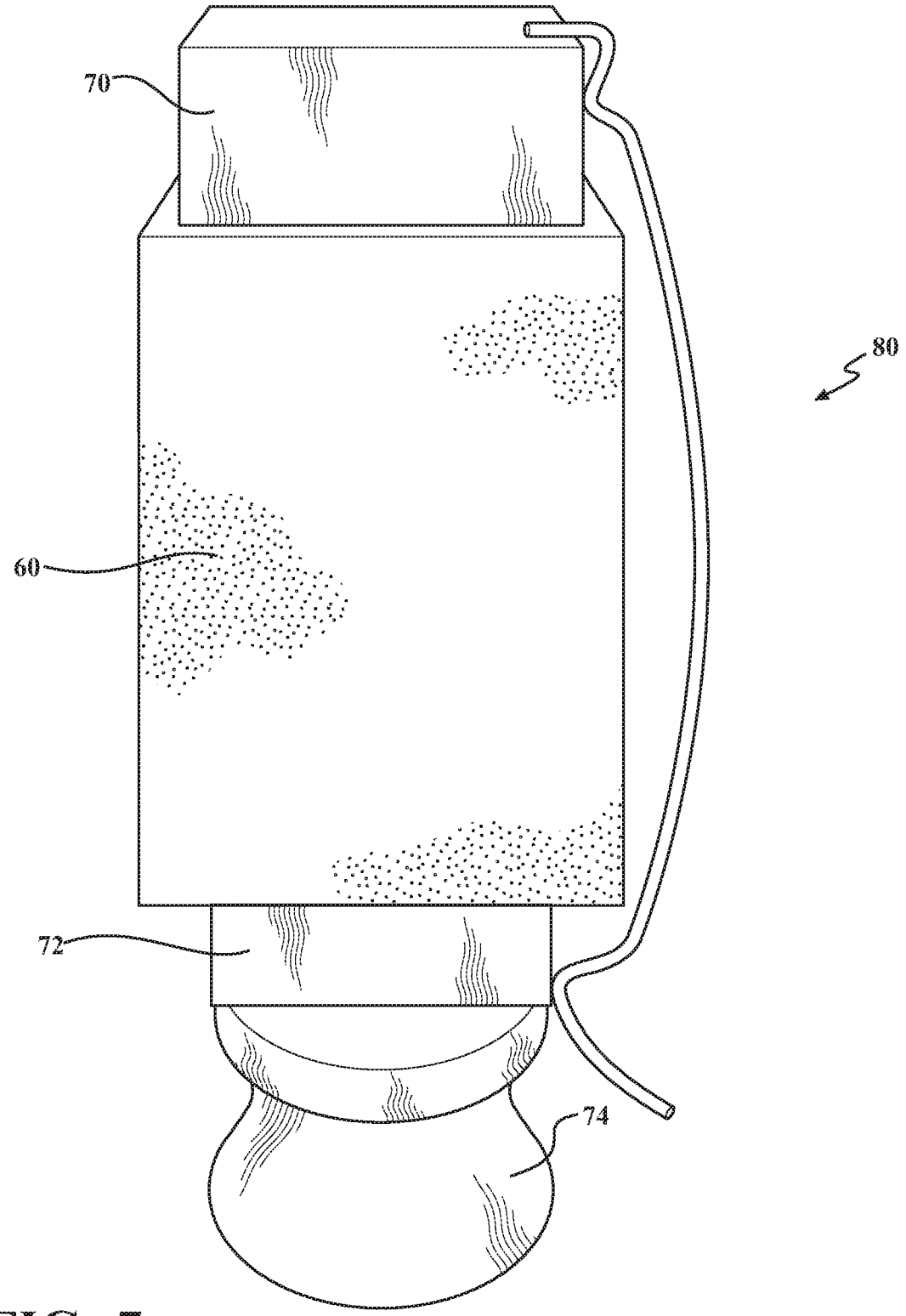
FIG. 7 is a schematic view of a mold assembly for the method to manufacture reticulated metal foam.

Next, the wax gating 40 and attached coated precursor 30 is pre-invested by pouring a slurry of diluted pre-investment ceramic plaster into the container 50 to form a pre-investment block 60 (step 110; FIG. 6, FIG. 7). The pre-investment may be performed with a ceramic plaster such as, for example, an Ultra-Vest® investment manufactured by Ransom & Randolph® of Maumee, Ohio, USA.

The ceramic plaster may be mixed per manufacturer's recommendations However, it may be desirable, in some embodiments, for the ceramic plaster to be highly diluted, e.g., water to powder ratio of 55:100 used for Ultra-Vest® as compared to the manufacturer's recommended 39-42:100 to provide the diluted pre-investment ceramic plaster. It should be appreciated that various processes may be utilized to facilitate pouring such as a vibration plate to facilitate slurry infiltration into the coated precursor 30; location in a vacuum chamber to remove trapped air; etc. If a vacuum chamber is employed, the vacuum may be released once bubbles stop breaching the surface, or slurry starts setting up. The container 50 may then be topped off with excess slurry if necessary.

The highly water-diluted ceramic plaster reduces the strength of the ceramic, which facilitates post cast removal. The highly water-diluted ceramic plaster also readily flows into the polymer reticulated foam structure, ensuring 100% investment. This is significant in the production of very dense, fine pore, metal foams. This pre-investment may thus take the form of a block, panel, brick, sheets, etc. Once pre-invested, a rectangular prism of the diluted investment plaster with the foam encapsulated inside may be formed.

The pre-investment block 60 is then allowed to harden, e.g., for about 10 minutes, and once set, transferred to a humidity controlled drying room. In some embodiments, the final pre-investment block 60, when solidified, may be only slightly larger than the original polyurethane foam precursor 20 shape. This facilitates maintenance and support of the precursor 20 structural integrity that may be otherwise compromised. That is, the shape of the precursor 20 is protected within the pre-investment material. After the pre-investment block 60 is dried or sufficiently dried, a wax assembly procedure (step 112) may be performed. In some embodiments, the wax assembly procedure may be performed after about 2 hours drying time.

The wax assembly procedure (step 112) may include attachment of gates 70, 72, and a pour cone 74, to the pre-investment block 60 to form a gated pre-investment block 80 (FIG. 7). Alternatively, multiple pre-investment blocks 60 may be commonly gated as a gated pre-investment block 80.

Figure 8:
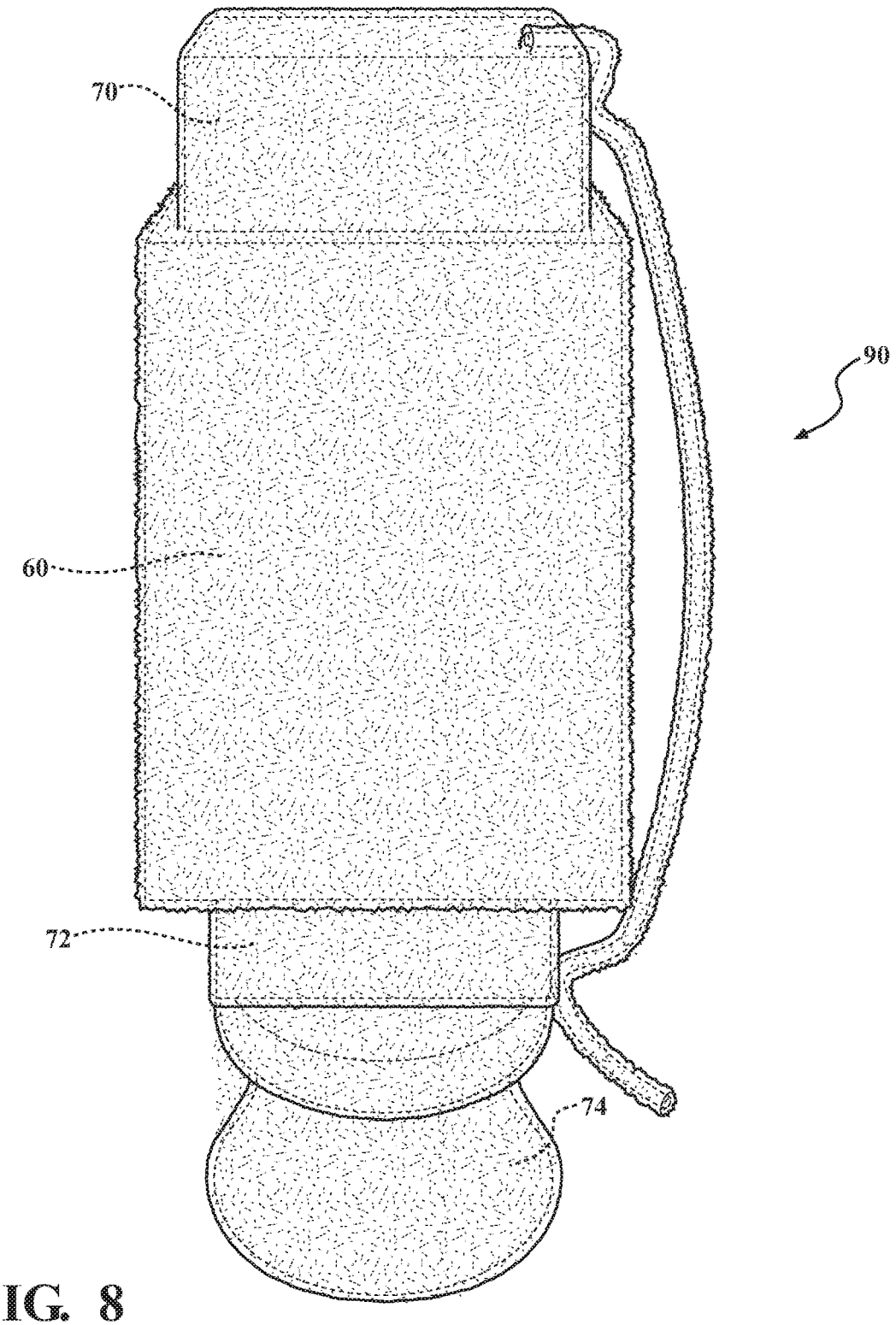
FIG. 8 is a schematic view of a shell mold applied to the mold assembly to form a second, final, investment for casting.

Next, the outer mold assembly 82 is applied as a shell-mold to provide the build-up around the preinvest/gating assembly to prepare the final mold 90 for the final investment (step 114). A shell-mold in this disclosure refers to the building of an investment mold by applying alternating layers of slurry and stucco on a pattern (FIG. 8). In common industry language, this is often referred to simply as "investment casting." In one example, the materials utilized include a colloidal silica suspension binder within an aqueous solution having a zirconia and/or alumina aggregate which provides an approximate 0.375" (9.5 mm) buildup on all surfaces. The final mold 90 is thereby significantly more rigid and robust than the pre-investment ceramic plaster.

The use of a shell-mold system reduces material cost relative to a solid mold technique. Additionally, shell-mold applications may enable automation to facilitate a relatively high through-put and economies of scale for investing and component manufacturing.

The use of the terms "a," "an," "the," and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other. It should be appreciated that relative positional terms such as "forward," "aft," "upper," "lower," "above," "below," and the like are with reference to normal operational attitude and should not be considered otherwise limiting.

Although the different non-limiting embodiments have specific illustrated components, the embodiments of this disclosure are not limited to those particular combinations. It is possible to use some of the components or features from any of the non-limiting embodiments in combination with features or components from any of the other non-limiting embodiments.

It should be appreciated that like reference numerals identify corresponding or similar elements throughout the several drawings. It should also be appreciated that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is illustrative rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed:

1. A method to manufacture reticulated metal foam via a dual investment, comprising:

pre-investing a precursor with a pre-investment ceramic plaster to encapsulate the precursor;

applying an outer mold to the encapsulated precursor as a shell-mold;

coating the precursor in a molten wax to increase ligament thickness to provide an about 90% air to 10% precursor ratio; and wherein the pre-investment ceramic plaster is diluted more than about 39-42:100.

2. The method as recited in claim 1, wherein the precursor is a reticulated foam.

3. The method as recited in claim 1, wherein the precursor is a polyurethane foam.

4. The method as recited in claim 1, wherein the precursor is completely encapsulated with the pre-investment ceramic plaster.

* * * * *